US008789323B2

(12) United States Patent
Rasmussen

(10) Patent No.: US 8,789,323 B2
(45) Date of Patent: Jul. 29, 2014

(54) METHOD FOR ATTACHMENT OF AN OBJECT TO A THIN-WALLED PROFILE, SUCH AS A FIBRE GLASS REINFORCED PROFILE MADE BY PULTRUSION, AND SUCH A PROFILE

(75) Inventor: Johnny Christian Nygaard Rasmussen, Hedenstand (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 13/339,326

(22) Filed: Dec. 28, 2011

(65) Prior Publication Data

US 2012/0167508 A1 Jul. 5, 2012

(30) Foreign Application Priority Data

Dec. 29, 2010 (EP) ..... 10197260

(51) Int. Cl.
*E06B 3/00* (2006.01)

(52) U.S. Cl.
USPC ..... 52/204.5

(58) Field of Classification Search
USPC ..... 52/309.13, 204.1, 213, 204.5, 208, 52/204.55, 204.65, 204.67, 204.72
See application file for complete search history.

(56) References Cited

U.S. PATENT DOCUMENTS

| | | | | |
|---|---|---|---|---|
| 6,360,498 | B1 * | 3/2002 | Westphal | 52/204.5 |
| 7,971,400 | B2 * | 7/2011 | Boldt et al. | 52/204.1 |
| 2003/0024179 | A1 * | 2/2003 | Cates et al. | 52/204.1 |
| 2005/0166493 | A1 * | 8/2005 | Martin | 52/204.1 |
| 2006/0053707 | A1 * | 3/2006 | Palenske CI | 52/204.1 |
| 2006/0272234 | A1 * | 12/2006 | Curtis | 52/204.1 |
| 2008/0178541 | A1 * | 7/2008 | Kerscher et al. | 52/204.1 |
| 2009/0077909 | A1 * | 3/2009 | Barthel | 52/204.1 |
| 2009/0193728 | A1 * | 8/2009 | Butler et al. | 52/213 |
| 2009/0277111 | A1 * | 11/2009 | Albrecht et al. | 52/213 |

FOREIGN PATENT DOCUMENTS

| | | | |
|---|---|---|---|
| DE | 202005005795 | U1 | 12/2005 |
| DE | 202008004373 | U1 | 9/2008 |
| FR | 2624157 | A1 | 6/1989 |

* cited by examiner

*Primary Examiner* — Jessica Laux
(74) *Attorney, Agent, or Firm* — Merek, Blackmon & Voorhees, LLC

(57) ABSTRACT

The invention relates to a method for attachment of an object to a thin-walled profile with a number of walls by means of one or more threaded fastening members. Each fastening member is driven into an open-ended space between two walls of the profile, where the opening faces an outer surface of the profile, and the space has a width corresponding substantially to the minor diameter of the thread. Fastening members can be screws or bolts, a retaining member can be applied to prevent the two walls from moving away from each other and a filler or glue may be provided in the space before the introduction of the fastening member. The profile can be made from a plastic matrix reinforced with fiber glass and made by pultrusion.

7 Claims, 1 Drawing Sheet

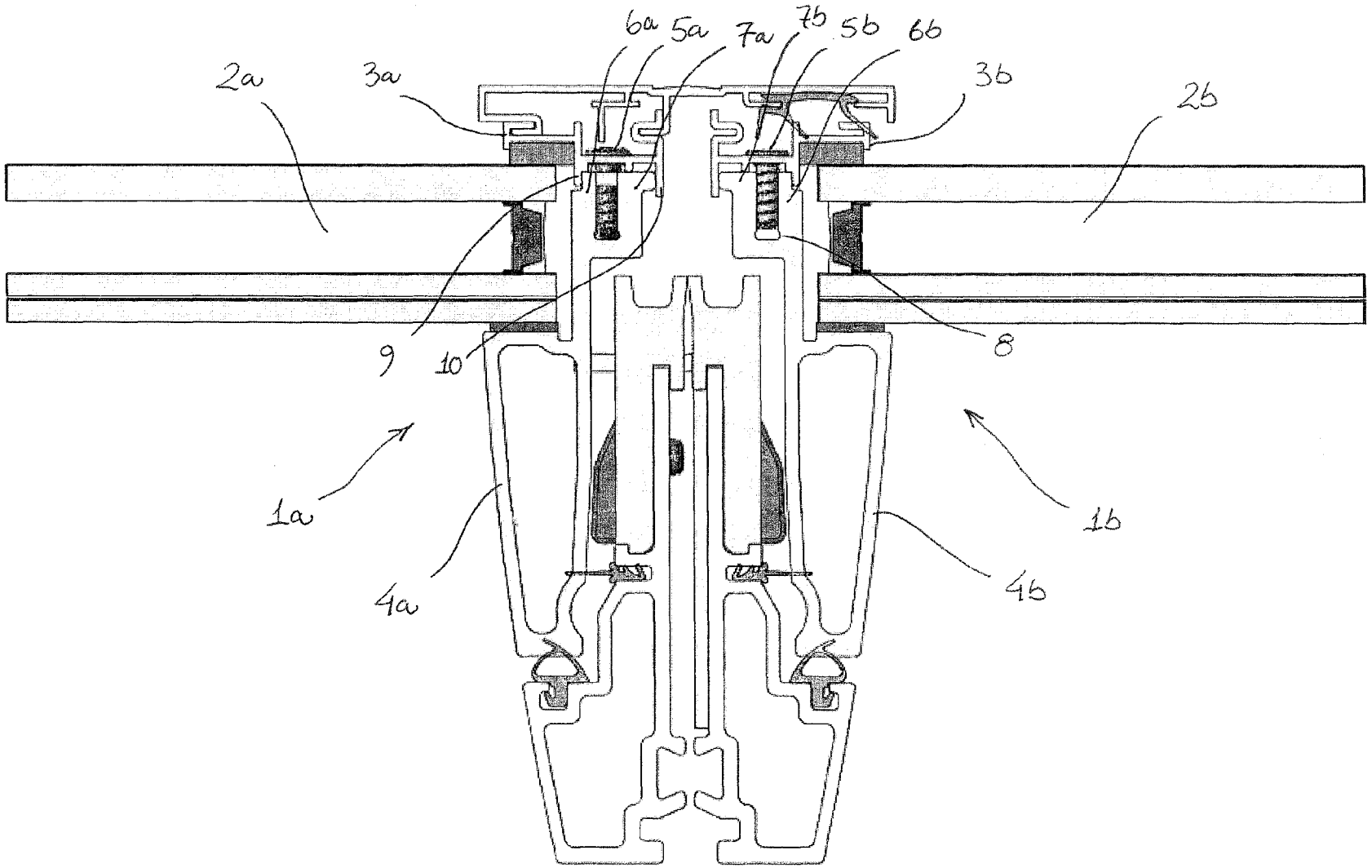
2b
3b
6b
5b
7b
7a
5a
6a
3a
2a
8
10
9
1b
4b
4a
1a

METHOD FOR ATTACHMENT OF AN OBJECT TO A THIN-WALLED PROFILE, SUCH AS A FIBRE GLASS REINFORCED PROFILE MADE BY PULTRUSION, AND SUCH A PROFILE

The present application claims the priority under 35 U.S.C. 119 of European Patent Application No. 10197260.2, filed Dec. 29, 2010, which is hereby incorporated herein by reference in its entirety.

The present invention relates to a method for attachment of an object to a thin-walled profile, such as a fibre glass reinforced profile made by pultrusion, said profile being formed with a number of walls, and where the attachment is achieved by means of one or more threaded fastening members. The invention also relates to a fibre glass reinforced profile made by pultrusion.

Fibre glass reinforced profiles are typically used as an alternative to profiles of aluminium. They have the advantage that they are relatively cheap and easy to manufacture and have smaller carbon footprints. At the same time they are highly resistant to moisture and heat, which makes them well suited for use in window frames and like applications.

There is, however, one major problem, which have had a negative influence on the use of fibre glass reinforced profiles, namely that the high content of glass, which is typically 60-80%, makes it relatively difficult to cut and drill in them. The tools used are simply worn down and has to be sharpened or replaced very frequently and the idea of simply driving screws directly into the profiles fails for the same reason. Another problem related to the high fibre content is that the profiles tend to delaminate during reworking.

Gluing is of course an option, but, as is well-known to the skilled person, glue joints are not always sufficiently strong and reliable.

It is therefore the object of the invention to provide an alternative method for attachment of an objects to thin-walled profiles, such as a fibre glass reinforced profiles made by pultrusion, profiles made from ceramics and like profiles, where there is a desire to minimise the need for drilling.

This object is achieved by a method, where the/each fastening member is driven into an open-ended space between two walls of the profile, where the opening faces an outer surface of the profile and where the space has a width corresponding substantially to the minor diameter of the thread, typically 2-20 mm. In the overall perspective the walls will be substantially parallel, but small variations are acceptable and variations in wall thickness may cause the inner and/or outer sides to be located at and angle to each other.

In this way the fastening member is clamped between the two walls, which, when seen in cross-section, form a pocket hole. The walls are forced slightly apart during insertion, and the thread, which penetrates into the surface of the two walls, serves as barbs preventing the fastening member from being pulled out again. The surface of the profile walls consist primarily of the matrix material, which is a polymer, typically polyurethane or polypropylene, and therefore does not degrade the thread of the fastening member to any considerable degree.

The clamping effect may be increased by using a profile, where the distance between the two walls varies and has a minimum at the space opening. It can also be advantageous that at least one of the walls is provided with a weakening zone at a distance from the opening allowing the wall, which may otherwise be relatively stiff, to bend. The distance from the opening to the weakening zone should ideally be slightly bigger than the length of the fastening member employed.

The fastening members are preferably screws, since the pointed end will ease the insertion into the opening between the walls, but bolts may also be employed. Moreover, nails or spikes having ridges around the circumference of their body may also be regarded as threaded within the meaning of the present application.

When the fastening member is of a configuration having a head and an elongate body carrying the thread, such as a screw or bolt, it is preferred that, in the mounted state, the body is positioned entirely in the space between the two walls, while at least a part of the head is outside the space.

Over time the presence of the fastening member combined with relaxation in the matrix material can cause the two walls to move slightly away from each other, which may cause the fastening member to become loose. To avoid this, it is preferred to apply a retaining member keeping the two walls in place. When the ends of the two walls are substantially at the same level, the retaining may simply be a metal bracket spanning over both of them. Another example of a retaining is a support arranged between one of the two walls and another wall in the profile. When the profile is used for a window frame or sash, care should, however, be taken that the retaining member does not form an undesirable thermal bridge.

In order to provide an even better attachment, a filler or glue can be introduced into the space before the fastening members. This filler or glue will contribute to fixating the fastening member, not only with regards to movement out of the space, but also against movement in the length direction of the profile. A filler or glue may also function as a lubricant during insertion of the fastening member.

In this, the invention is described with relation to fibre glass reinforced profiles made by pultrusion. The problems described in relation to these may, though possibly less pronounced, also occur when using profiles made from ceramics and even aluminium and other more traditional materials, and the invention is therefore limited neither to profiles made by pultrusion nor to those reinforced with fibre glass.

In the following, the invention will be described with reference to the drawing in which FIG. 1 shows a cross-sectional view of two windows 1*a*, 1*b* mounted side-by-side. The panes 2*a*, 2*b* of the windows are kept in place by means of glazing lists 3*a*, 3*b*, which are attached to the sash members 4*a*, 4*b* by means of screws 5*a*, 5*b* according to an embodiment of the invention.

Whenever a reference number is used, which does not include an a or b, this is to be understood as an indication, that reference is made to the particular feature in general and that there is no substantial difference between the to windows.

The screw 5, which is used as fastening member in this embodiment, is located in a pocket hole, which is formed by two walls 6,7 of the profile constituting the sash 4 and is open towards an outer side of the profile. On the left-hand side the length of the screw 5*a* corresponds to the depth of the hole and on the right-hand side the screw 5*b* is somewhat shorter.

The distance between the walls 6,7 corresponds to the minor diameter of the thread of the screw, meaning that the thread cuts into the interior side surfaces of the walls and that a clamping effect is achieved where the walls presses on the sides of the screw.

In the embodiment shown, the walls 6,7 are parallel and with straight interior sides, but this need not be the case. An improved clamping effect may be achieved by arranging the walls in a slightly angle position in relation to each other so that the distance between them is smallest at the opening or by providing a local projection at the opening. Alternatively, if using tapered screws the walls may be arranged at an angle to each other so that the shape of the space between them corresponds to the shape of the screw. These variations in angle may be achieved by making the walls with non-constant thickness. Finally, giving the walls a profiled surface may contributes to the attachment of the fastening member and possibly ease introduction of the fastening member.

At the bottom, the hole has a bulge 8 as may best be seen on the right-hand window. The bulge serves as a weakening zone and when the screw 5 is introduced into the hole, the walls bend slightly at this place, thereby easing the introduction. In this embodiment both walls have free ends, which allows them both to bend, but this need not be the case.

The bending of the walls 6,7 is an advantage during the initial introduction of the screw 5, but may subsequently result in the screw coming loose. To avoid this the glazing list 3 is designed with two legs 9, 10, which, in the mounted state, lies closely along the outer side of the walls 6,7. In this way the glazing list functions as a retaining member keeping the two legs from moving away from each other. This is considered an advantage since the retaining function is achieved without increasing the number of different components needed for the construction of the window, but separate members may of course also be employed.

When two windows are mounted side-by-side as shown in the drawing, a retaining function could also be achieved with a member arranged between the walls 7*a*,7*b* facing the opposite window. Such a member could be formed as a projection on one wall or both of these walls 7*a*,7*b*. This embodiment is, however, not suited for windows with sashes that can be opened.

The invention claimed is:

1. A method for attachment of an object to a thin-walled fibre glass reinforced profile made by pultrusion with a number of walls, where the profile is a sash of a window, the method including the steps of:

attaching the object to the profile using one or more threaded fastening members, the thread of the/each fastening member having an minor diameter and a major diameter, where the/each fastening member is driven into an open-ended space between two walls of the profile, said open-ended space having an opening facing an outer surface of the profile for receiving the/each fastening member, where the opening has a width corresponding substantially to the minor diameter of the thread; and, applying a retaining member to prevent the two walls from moving away from each other after the/each fastening member is driven into the open-ended space, and wherein at least one of the two walls delimiting the open-ended space is provided with a weakening zone at a distance from the opening allowing the wall to bend when the fastening member is driven into the open-ended space, the open-ended space includes a distal end opposite said opening, a first section of said open-ended space adjacent said opening has a first width, a second section adjacent said distal end has a second width, said second width is greater than said first width thereby forming the weakening zone.

2. A method according to claim 1, where the fastening member is a screw or bolt.

3. A method according to claim 1, where a filler or glue is provided in the space before the introduction of the fastening member.

4. The method of claim 1, wherein the two walls of the profile are substantially parallel and located at a distance of 2-20 mm, at least one of these walls having a free end.

5. The method of claim 4, wherein the the thin-walled profile is made from a plastic matrix reinforced with fibre glass.

6. The method of claim 4, wherein the distance between the two walls varies and has a minimum at the space opening.

7. The method of claim 1, wherein a distance between the two walls varies and has a minimum at the space opening.

* * * * *